United States Patent [19]

Arai et al.

[11] Patent Number: 4,511,788

[45] Date of Patent: Apr. 16, 1985

[54] LIGHT-RADIANT HEATING FURNACE

[75] Inventors: Tetsuji Arai, Tachikawa; Yoshiki Mimura, Yokohama, both of Japan

[73] Assignee: Ushio Denki Kabushiki Kaisha, Tokyo, Japan

[21] Appl. No.: 574,453

[22] Filed: Jan. 27, 1984

[30] Foreign Application Priority Data

Feb. 9, 1983 [JP] Japan ..... 58-18870
Feb. 9, 1983 [JP] Japan ..... 58-18871

[51] Int. Cl.[3] ..... H05B 3/06; F27B 5/14

[52] U.S. Cl. ..... 219/405; 219/354; 219/411; 219/343

[58] Field of Search ..... 219/405, 411, 354, 343, 219/347, 390, 350, 351, 352

[56] References Cited

U.S. PATENT DOCUMENTS

| | | | |
|---|---|---|---|
| 793,424 | 6/1905 | Custer | 219/390 |
| 2,677,748 | 5/1954 | Naylor | 219/354 |
| 3,005,081 | 10/1961 | Kordes | 219/343 |
| 3,102,942 | 9/1963 | Lefebvre | 219/347 |
| 3,217,139 | 11/1965 | Barber | 219/352 |
| 3,240,915 | 3/1966 | Carter | 219/354 |
| 3,862,397 | 1/1975 | Anderson | 219/405 |
| 4,101,759 | 7/1978 | Anthony | 219/343 |
| 4,435,819 | 3/1984 | Plume | 373/137 |

*Primary Examiner*—Roy N. Envall, Jr.
*Assistant Examiner*—Teresa J. Walberg
*Attorney, Agent, or Firm*—Ziems, Walter & Shannon

[57] ABSTRACT

A light-radiant heating furnace is formed of a multi-plane light source constructed by arranging in combination a plurality of plane light source units, each of which is constructed of a plurality of lamps arranged side by side, along a vertically-extending axis in such a manner that the plane light source units surround a heating space. Each of the lamps includes an elongated and sealed tubular envelope and a filament, which has alternately non-luminous portions and luminous portions, and is disposed in such a manner that it extends in a direction perpendicular to the vertically-extending axis. It is preferred to use frame members each of which has two plate portions extending at a predetermined angle relative to each other and defining lamp-supporting holes at different levels. The light-radiant heating furnace can heat an object either uniformly or with a desired temperature distribution to a desired high temperature. Its structure is extremely simple and its assembly is thus easy. It can utilize with high efficiency light radiated from the lamps.

3 Claims, 8 Drawing Figures

LIGHT-RADIANT HEATING FURNACE

BACKGROUND OF THE INVENTION (1) Field of the Invention

This invention relates to a light-radiant heating furnace.

(2) Description of the Prior Art

Among a variety of apparatus adapted generally to carry out heat treatments therein, light-radiant heating furnace in which light radiated from a lamp or lamps is irradiated onto objects or materials to be treated (hereinafter referred to merely as "objects") for their heat treatment have following characteristic merits:

(1) Owing to an extremely small heat capacity of each lamp per se, it is possible to raise or lower heating temperature promptly;

(2) Since they feature indirect heating by virtue of light radiated from their lamps which are not brought into contact with objects, the objects are protected from contamination;

(3) They enjoy less energy consumption because full-radiation-state operations of the lamps are feasible in short time periods after turning the lamps on and energy efficiencies of the lamps are high; and (4) They are relatively small in size and low in manufacturing costs compared with conventional resistive furnaces or high-frequency heating furnaces.

Such light-radiant heating furnaces have been used for heat treatment and drying of steel materials and the like and molding of plastics as well as in thermal characteristics testing apparatus and the like. Use of light-radiant furnaces have, particularly recently, been contemplated to replace the conventionally-employed resistive furnaces and high-frequency heating furnaces for carrying out certain semiconductor fabrication processes which require heating, for example, diffusion processes of dopant atoms, chemical vapor deposition processes, healing processes for crystal defects in ion-implanted layers, thermal treatment processes for electrial activation, and thermal processes for nitrifying or oxidizing surfaces of silicon wafers. As reasons for the above move, may be mentioned such advantages of light-radiant heating furnaces that objects under heat treatment are free from contamination, their electric properties are not deleteriously affected and the light-radiant heating furnaces require less power consumption.

Light-radiant heating furnaces have a variety of such advantages as mentioned above and have found widespread commercial utility in industry. Conventional light-radiant heating furnaces are however accompanied by a drawback that they are unable to heat objects uniformly to desired high temperatures in their entirety. Namely, a lamp has a sealed envelope made of silica glass or the like and forms a point light source or a line light source. It is thus unable to form any plane light source extending two-dimensionally, when used singly. Thus, it cannot heat an object uniformly to a desired high temperature in its entirety although it may be able to heat a part of the object uniformly.

SUMMARY OF THE INVENTION

With the foregoing in view, the present invention has as an object thereof the provision of a novel light-radiant heating furnace which can heat an object either uniformly or with a desired temperature distribution to a desired high temperature in its entirety without failure irrespective of the configuration of the object.

Another object of this invention is to provide a light-radiant heating furnace of such a novel construction that its structure is extremely simple and thus facilitates its assembly as well as light radiated from lamps can be utilized with good efficiency.

In one aspect of this invention, there is thus provided a light-radiant heating furnace which comprises:

a multiplane light source constructed by arranging in combination a plurality of plane light source units, each of which is contructed of a plurality of lamps arranged side by side, around a vertically-extending axis in such a manner that the plane light source units surround a heating space;

each of which lamps includes an elongated and sealed tubular envelope and a filament provided along an elongated axis of the sealed envelope, and is disposed in such a manner that it extends in a direction perpendicular to the vertically-extending axis, said filament having alternately non-luminous portions and luminous portions.

In another aspect of this invention, there is also provided a light-radiant heating furnace which comprises an assembly of:

at least a first, second and third frame members, each of which has two plate portions, arranged in such a manner that one of the plate portions of the first frame member opposes one of the plate portions of the second frame member disposed adjacent to the first frame member, and the other plate portion of the first frame member opposes one of the plate portions of the third frame member disposed adjacent to the first frame member at a side different from the second frame member;

a plurality of lamps making up a first plane light source unit and supported between the first frame member and the second frame member with sealed end portions thereof positioned at one side extending out through first supporting holes formed through the one of the plate portions of the first frame member;

another plurality of lamps making up a second plane light source unit and supported between the first frame member and the third frame member with sealed end portions thereof positioned at one side extending out through the second supporting holes formed, at levels different from the first supporting holes by a distance equal to on more than outer diameter of the lamp, through the other plate portion of the first frame member;

a first reflector provided fixedly with the first frame member in such a manner that the first reflector assumes a position predetermined relative to the first supporting holes and extends between the first frame member and the second frame member; and a second reflector provided fixedly with the first frame member in such a manner that the second reflector assumes a position predetermined relative to the second supporting holes and extends between the first frame member and the third frame member.

The above light-radiant heating furnaces of this invention can heat objects either uniformly or with desired temperature distributions to desired high temperatures in their entirety without failure irrespective of the configurations of the objects. Their structures are extremely simple, whereby facilitating their assembly work. In the light-radiant heating furnaces, light radiated from lamps can be utilized for heating with high efficiency.

The above and other objects, features and advantages of the present invention will become apparent from the following description and the appended claims, taken in conjunction with the accompanying drawings.

DETAILED DESCRIPTION OF THE INVENTION AND PREFERRED EMBODIMENTS

Figure 1:
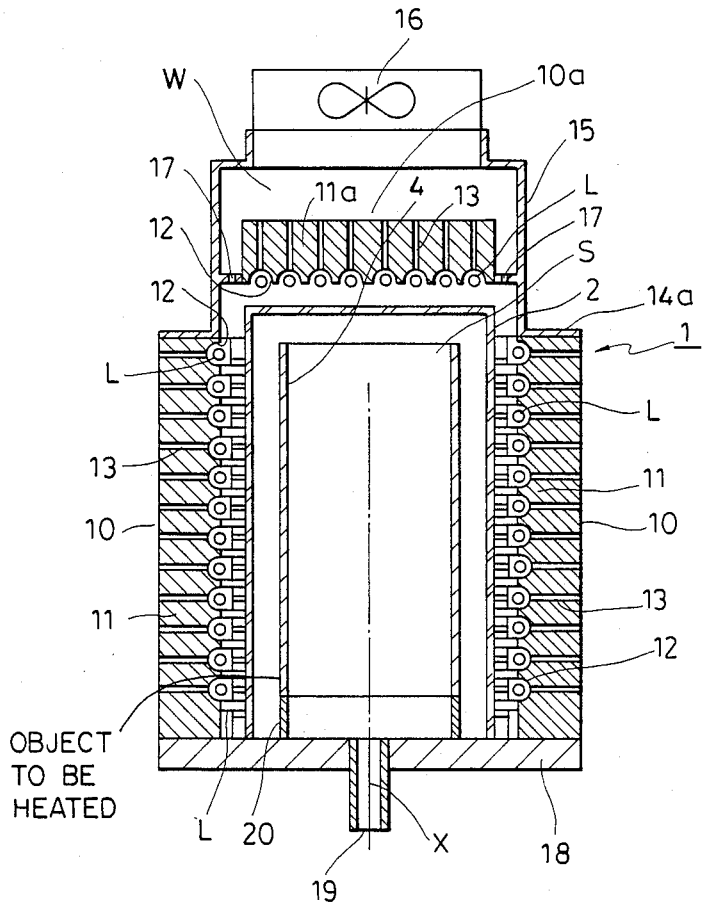
FIG. 1 is a schematic, vertical, cross-sectional, side view of a light-radiant heating furnace according to one embodiment of this invention.
Figure 2:
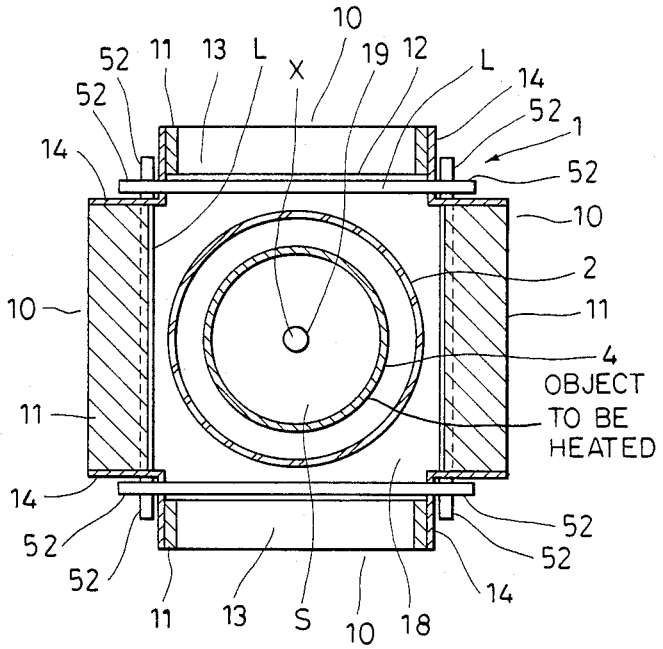
FIG. 2 is a schematic, horizontal, cross-sectional, plan view of the light-radiant heating furnace of FIG. 1.
Figure 3:
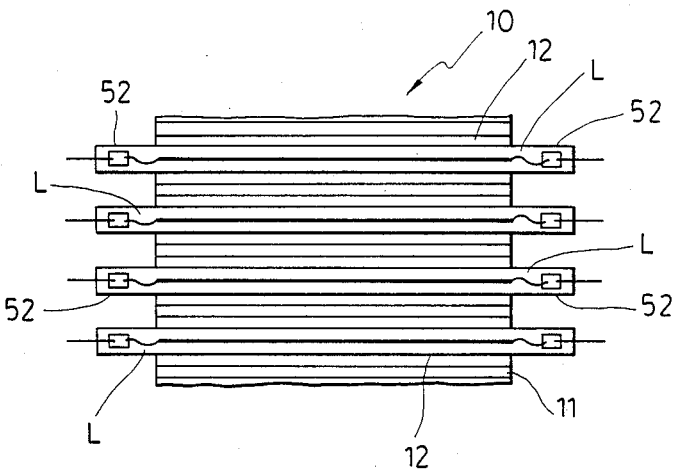
FIG. 3 is a schematic illustration showing one example of a plane light source unit.
Figure 5:
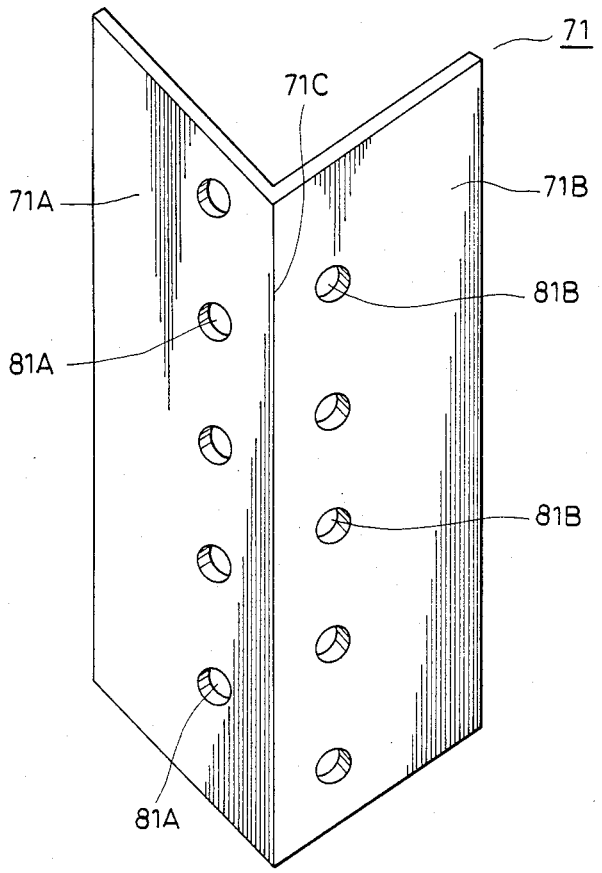
FIG. 5 is a schematic perspective view illustrating one exmaple of a frame member.

FIGS. 1 and 2 illustrate the structure of a light-radiant heating furnace which pertains to one embodiment of this invention and is suitable for vapor deposition. In this embodiment, numeral 1 indicates a, for example, cylindrical multiplane light source provided in such a manner that a heating space S is surrounded in which an object is to be placed for its heating. In the multiplane light source 1, a plurality of plane light source units 10 (four plane light source units in the illustrated embodiment), each of which is formed by a plurality of lamps L such as tubular halogen lamps arranged side by side so that the axes of the lamps extend in the same direction, as illustrated in detail in FIG. 3, are arranged respectively four sides of the heating space S so that they are combined into the shape of a prism having square bases and extending along a vertically-extending axis X. An additional top plane light source unit 10*a* having a construction similar to each plane light source unit 10 is arranged over the heating space S to close up an upper opening defined by the four plane light source units 10. With these five plane light source units 10 and 10*a*, an opening is defined at the lower extremity thereof. In each of the plane light source units 10, each lamp L is provided in such a manner that it extends in a direction perpendicular to the axis X. Here, the term "a direction perpendicular to the axis X" does not mean a direction perpendicular precisely to the axis X only but should be construed in such notion that both right angle and substantially right angle are embraced therein. When the lamps L are solely taken into consideration, the lamps L are arranged, as clearly shown in FIG. 2, one over another in parallel crosses. The hermetically-sealed end portions 52, which are located respectively at both ends of each lamp L, extend out of the heating space S. The hermetically-sealed end portions 52 are shielded by their corresponding holder 14, as will be described later, so that the hermetically-sealed end portions 52 are not exposed to light radiated from other lamps L. In each of the plane light source unit 10, a reflector 11 which is made of aluminum and is plated on its reflecting surface with gold is provided behind the lamps L. The reflector 11 is provided, in a surface facing its corresponding lamp L, with a light-directing concave reflector surface 12 which extends along the axis of the corresponding lamp L. The concave reflector surface 12 defines centrally an air passageway which extends in the lengthwise direction thereof and is communicated through an air conduit 13 with the exterior atmosphere at the back wall of the reflector 11. The holders 14 connect the plane light source units 10 together and hold them in place. The holder 14 may, for example, have such a structure as will be described later with reference to FIGS. 5 and 6. Each of the holders 14 also holds with an adjacent holder the lamps L and a reflector 11 in corresponding plane light source unit 10. An upper holder 14*a* connected to the holders 14 at their top parts holds the lamps L and the reflector 11*a* in the top plane light source unit 10*a*. An air duct W is formed by an air guide member 15 which is coupled as a unitary member with an upper holder 14*a* and covers the side walls and back wall of the reflector 11*a* to define an air-path therebetween. An exhaust fan 16 is provided in an upper opening of the air guide member 15. Designated at numeral 17 are air passages. Numeral 18 indicates a supporting bottom plate which closes up the opening formed in the lower extremity of the multiplane light source 1 and supports the multiplane light source 1. Although not illustrated in the drawings, the supporting bottom plate 18 defines an opening through which an object may be charged and discharged. A pipe 19 for charging a gas such as a deposition gas therethrough is centrally provided on the supporting bottom plate 18, and another pipe (not shown) for discharging gas therethrough also provided. In the multiplane light source 1, a water-cooling system is also provided to cool each of the reflectors 11 although it is not illustrated in the drawings.

Figure 4:
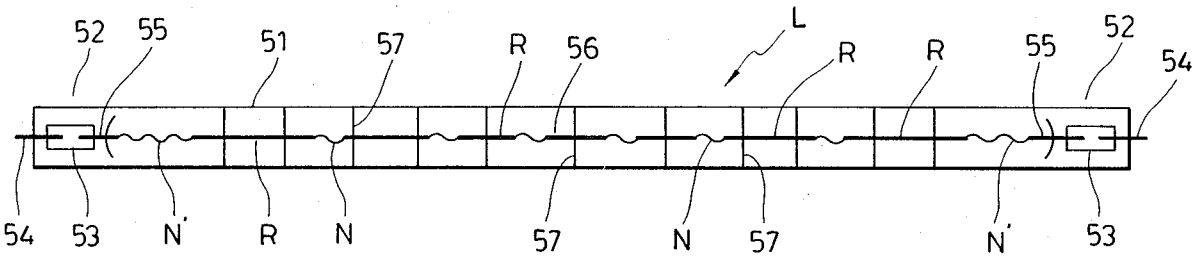
FIG. 4 is a schematic illustration showing one example of the structure of a lamp.

One example of the specific structure of each of the lamps L will next be described. As shown in FIG. 4, the lamp L is formed of a sealed tubular envelope 51 made of silica glass, thin metal foils 53, 53 embedded respectively in hermetically-sealed end portions 52, 52 which are formed at both ends of the sealed envelope 51 respectively, outer leads 54, 54 extending respectively from the thin metal foils 53, 53 to the exterior of the sealed envelope 51, inner leads 55, 55 extending respectively from the thin metal foils 53, 53 to the interior of the sealed envelope 51, a filament 56 connected between the inner leads 55, 55 and arranged along the longitudinal axis of the sealed envelope 51, and filament supports 57. The filament 56 is alternately provided with non-luminous portions N and luminous portions R and has non-luminous end portions N', N' at both ends thereof. The sealed envelope 51 contains a halogen gas. Leads of each of the lamps L are connected to a power source for operating the lamps L.

Designated at numeral 2 is a transparent cylindrical isolation member which is provided to divide the heating space S from the surrounding external atmosphere and is, for example, made of silica. The isolation member 2 is provided close to the multiplane light source 1 and also serves to guide the cooling air for cooling the lamps L. Namely, cooling air is introduced from the external atmosphere through the air passageways 13 of the plane light source units 10 provided along four sides of the heating space S when the exhaust fan 16 is rotated. The thus-introduced air travels from the concave reflectors 12 and then by the lamps L, and thereafter flows upwardly along the outer wall of the isolation member 2. A portion of the air flows through the air passages 17 into the air duct W. The remaining portion of the air travels by the lamps L of the top plane light source unit 10*a* flows from the concave reflector surfaces 12, through the air passageways 13 and into the air duct W.

Numeral 4 indicates an object to be heated. In the illustrated embodiment, the object is for example a cylindrical substrate for deposition which is placed so that its axis coincides with the axis X, which extends vertically through the heating space S, is made of stainless steel and defines openings at both ends thereof. The substrate 4 is supported at its lower extremity thereof by a support member 20 provided on the supporting bottom plate 18.

Illustrative specific figures will next be given for the above embodiment. Each of the lamps L has an outer diameter of 10 mm and an overall length of 260 mm. The top plane light source unit 10*a* includes 8 lamps L each of which has a rated power consumption of about 400 W. The plane light source units 10, which are provided along the four sides of the heating space S, are each provided with 12 lamps L each of which has a rated power consumption of about 500 W. The cylindrical isolation member 2 is 200 mm in outer diameter and 3 mm in thickness. In the reflector 11, each of the concave reflector surfaces 12 is 20 mm wide and 190 mm long. These concave reflector surfaces 12 are formed side by side with an interval of 22 mm. The radiant-heating furnace is designed to heat the substrate 4 to a temperature of about 760° C. The maximum exhaustion rate of the exhaust fan 16 may be 10 $m^3$/min.

The light-radiant heating furnace of the above construction may for example be used to form a thin film in a vapor deposition process. It may for example be carried out in the following manner. For example, tetraethoxysilane gas is introduced as a deposition gas into the heating space S through the pipe 19. Light is then irradiated from the multiplane light source 1 onto the substrate 4 to heat the substrate 4 while causing the gas to overflow downwardly from the top of the substrate 4 along the outer peripheral wall thereof. Owing to the heat of the substrate 4, the deposition gas, namely, tetraethoxysilane is thermally decomposed on the substrate 4 and silicon oxide is caused to deposit on the outer pheripheral wall of the substrate 4, thereby forming a thin film of silicon oxide. By the above light-radiant heating furnace, it was actually possible to form a thin silicon oxide film of a uniform film thickness with deviation within ±10% on the substrate 4 at a growth rate of 200 Å/min.

In the above embodiment, the plurality of lamps L are arranged side by side at a high density above the heating space S and along the four sides of the heating space S to make up the multiplane light source 1. Although each of the lamp L forms a line light source when used singly, use of the plurality of the lamps L forms, as a matter of fact, a plane light source relative to the object placed in the heating space S. Moreover, such plane light sources are formed over the entire periphery of the object to be heated. Thus, it is possible to expose an object in its entirety uniformly to radiated light irrespective of its shape. Accordingly, the object can be heated in its entirety to a desired high temperature without failure no matter what shape the object has. Since each lamp L in each plane light soutce unit 10 is positioned in a direction perpendicular to the vertically-extending axis X, in other words, in such a manner that it extends in the horizontal direction, it is possible to use as the lamp L a halogen lamp containing a halogen gas in hermetically-sealed envelope 51 without encountering or raising any problems or inconvenience. Because it is possible to fabricate with ease halogen lamps of small sizes and high output powers, the heating furnace may be reduced in overall size while increasing its output power. If halogen lamps should be used by arranging them in such a manner that their axes extend vertically, their halogen cycles will cause locally in their respective envelopes due to a large temperature distribution and will thus not be carried out evenly, thereby raising a problem that the service life of the lamps will be terminated in an earlier stage.

Because each of the lamps L is of the partial luminescence type as mentioned above, it is possible to design a luminescence intensity distribution along the longitudinal axis thereof as one desires. Thus, a light irradiation intensity may be controlled in the horizontal direction relative to the object when the multiplane light source 1 is employed. As a result, it is possible to make the heating temperature strictly uniform or to make the heating temperature have a desired temperature distribution in the horizontal direction of the object.

By controlling by groups the electric power to be fed to the lamps L by means of the power control system, it is feasible to set at will a luminescence intensity distribution in the direction along which the lamps L are arranged side by side, namely, in the vertical direction. It is therefore possible to control the light irradiation intensity in the vertical direction of the object. As a result, the heating temperature of the object in the vertical direction may be rendered strictly uniform or may be caused to have a desired temperature distribution.

Furthermore, the hermetically-sealed end portions 52, 52 of each lamp L extend out from the heating space S and light directed from the other lamps L toward the hermetically-sealed end portions 52, 52 is shielded by the associated holder 14. Thus, the hermetically-sealed end portions 52, 52 are protected from being heated to high temperatures and hence damaged, thereby avoiding a reduction in its service life of each lamp L.

In addition, the atmosphere in the heating space S is isolated from the cooling air owing to the the provision of the isolation member 2. Thus, it is possible to carry out a stable heating operation without disturbing desirable manner of heating of the object. Where the isolation member 2 has, as mentioned above, a function to guide the cooling air, it is unnecessary to form any special additional channel for the cooling air. Thus, it is convenient to use an isolation member having such a function.

One embodiment of this invention has been described above by applying it to a deposition process. The present invention may however be varied or changed in various ways. For example, the object may be selected at will from a variety of objects of different types. Thus, the heating furnace may be applied for heat treatments in various fields. Besides the square based prism shape, the multiplane light source 1 may be formed into the shape of a pentagonal or still higher polygonal cylinder. Alternatively, the multiplane light source 1 may not be formed into a closed prism shape but may define an opening at a portion thereof. In some instances, the top plane light source 10*a* may be omitted. An additional plane light source unit may alternatively be provided at the bottom of the multiplane light source and an object may be charged and discharged at the top of the multiplane light source. As the lamps L, it is possible to use lamps other than halogen lamps.

Another embodiment of this invention is shown in FIGS. 5 through 8. In this embodiment, a first elongated frame member 71 of an L-shape in cross-section has a first plate portion 71A and a second plate portion 71B defines first supporting holes 81A (five supporting holes in the illustrated embodiment) through the first plate portion 71A at locations adjacent to a ridge 71C of the first frame member 71 in such a manner that the first supporting holes 81A are aligned in a row along the length of the frame member 71. In addition, second supporting holes 81B (five supporting holes in the illustrated embodiment) are also formed through the second plate portion 71B at locations adjacent to the ridge 71C of the first frame member 71 in such a manner that the second supporting holes 81B are aligned in a row along the length of the frame member and are formed at levels different from the first supporting holes 81A by a distance equal to or more than outer diameter of the lamp L, and the first supporting holes 81A and second supporting holes 81B are formed with the same interval and take respectively odd numbers and even numbers from the top toward the bottom.

Figure 6:
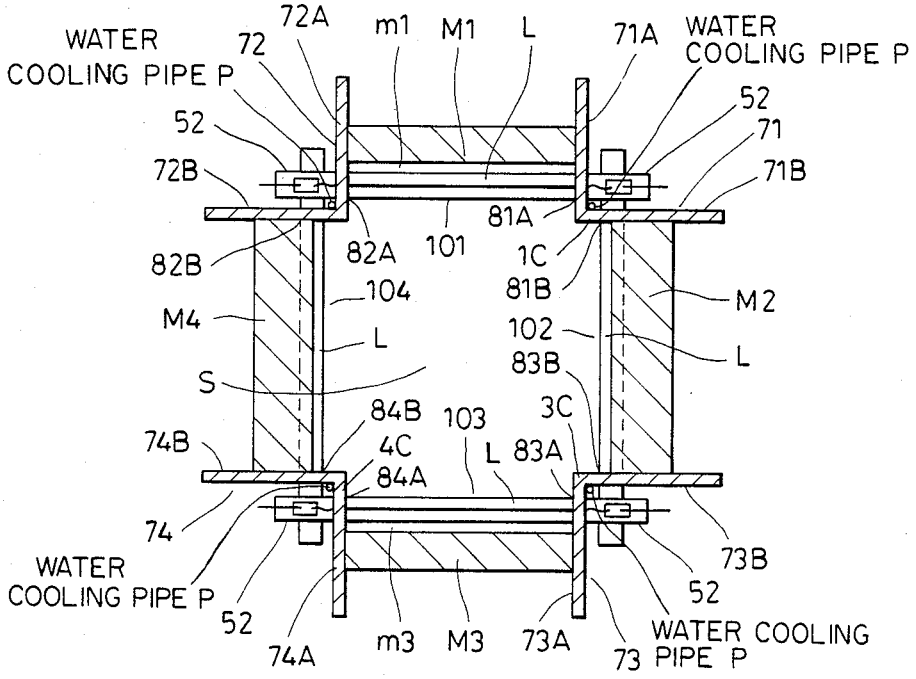
FIG. 6 is a schematic, horizontal, cross-sectional, plan view of a light-radiant heating furnace according to another embodimemt of this invention.

Facing the first plate portion 71A of the first frame member 71, a second frame member 72 formed symmetrically with the first frame member 71 is arranged, as illustrated in FIG. 6, in such a manner that a first plate portion 72A of the second frame member 72 opposes to the first plate portion 71A of the first frame member 71 and the levels of the first supporting holes 81A in the first plate portion 71A of the first frame member 71 are registered in the one-to-one relationship with the levels of the first supporting holes 82A in the first plate portion 72A of the second frame member 72 respectively.

Between the first frame member 71 and the second frame member 72, and more specifically between the first supporting holes 81A of the first frame member 71 and their corresponding second supporting holes 82A of the second frame member 72, lamps L are arranged by inserting them through the supporting holes 81A and supporting holes 82A with their hermetically-sealed end portions 52, 52 extending out from the plate portion 71A and plate portion 72A respectively, whereby forming a first plane light source 101. The first plane light source 101 is supported by the first frame member 71 and the second frame member 72.

Figure 7:
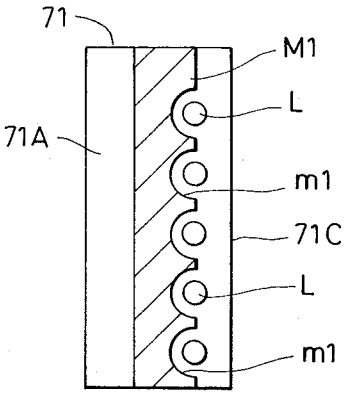
FIG. 7 is a schematic, fragmentary, cross-sectional view showing the positional relationship between lamps and their corresponding mirror.

Behind the first plane light source unit 101, a first reflector M1 which is for example made of aluminum, has for example grooves m1 (five grooves in the illustrated embodiment) and is equipped with a reflecting surface plated with gold is provided by fixing same on the first plate portion 71A of the first frame member 71 and the first plate portion 72A of the second frame member 72 in such a manner that, as also illustrated in FIG. 7, the first reflector M1 assumes a position predetermined relative to the first supporting holes 81A in the first frame member 71 and the first supporting holes 82A in the second frame member 72 disposed in such a manner that the first supporting holes 81A correspond respectively to the first supporting holes 82A. Each of the grooves m1 of the reflector M1 extends in a direction from its corresponding first supporting hole 81A of the first frame member 71 toward its corresponding first supporting hole 82A of the second frame member 72 and is formed, for example, into a semi-circular shape in cross-section.

Figure 8:
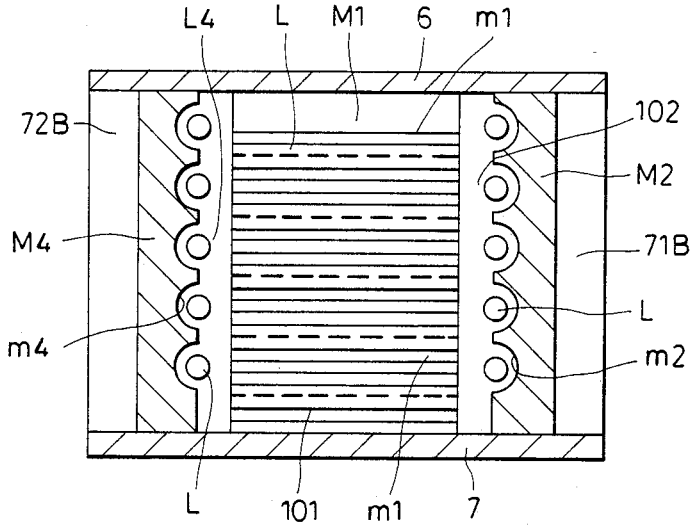
FIG. 8 is a schematic, vertical, cross-sectional, side view of the light-radiant heating furnace of FIG. 6.

Facing the second plate portion 71B of the first frame member 71, a third frame member 73 formed symmetrically with the first frame member 71 is disposed in such a manner that the second plate portion 73B of the third frame member 73 opposes to the second plate portion 71B of the first frame member 71 and the levels of the second supporting holes 81B formed through the second plate portion 71B of the first frame member 71 correspond in the one-to-one relationship to the levels of the second supporting holes 83B formed through the second plate portion 73B of the third frame member 73. Between the second plate portion 71B of the first frame member 71 and the second plate portion 73B of the third frame member 73, a second plane light source unit 102 and a second reflector M2 are arranged in the same manner as the first plane light source 101 and the first reflector M1 described above. Facing the second plate portion 72B of the second frame member 72 and the first plate portion 73A of the third frame member 73, a fourth frame member 74 formed in exactly the same manner as the first frame member 71 is provided in such a manner that the second plate portion 74B opposes to the second plate portion 72B of the second frame member 72, the first plate portion 74A opposes the first plate portion 73A of the third frame member 73, and the supporting holes 84A and supporting holes 83A formed respectively through mutually-facing plate portions and the supporting holes 84B and supporting holes 82B formed respectively through mutually-facing plate portions correspond at the same levels and in the one-to-one relationship. Between the first plate portion 73A of the third frame member 73 and the first plate portion 74A of the fourth frame member 74, a third plane light source unit 103 and a third reflector M3 are provided in the same manner as the first plane light source unit 101 and the first reflector M1 which have already been described above. Between the second plate portion 72B of the second frame member 72 and the second plate portion 74B of the forth frame member 74, a forth plane light source unit 104 and a fourth reflector M4 are provided in the same manner as the first plane light source unit 101 and the first reflector M1 which have already been described above. Furthermore, a top lid 6 is provided over the upper extremities of the frame members 71, 72, 73, 74 and a bottom plate 7 is provided under their lower extremities as shown in FIG. 8, whereby surrounding the heating space S.

As illustrated in FIG. 6, a cooling water pipe P made for example of copper is fixedly provided in contact with, for example, an inner corner portion of each of the frame members 71, 72, 73, 74 in such a manner that the pipe P extends along the length of its corresponding frame member. The specific structure of each of the lamps L may for example be identical to that illustrated in FIG. 4.

The second embodiment of this invention can bring about the following advantageous effects:

(1) The lamps in each group are supported by the supporting holes in the corresponding pair of frame members arranged adjacent to each other, and the reflector is fixedly provided at the specific position predetermined relative to the supporting holes. Therefore, it is always possible to install the lamps and reflectors with desired positional relationship. As a result, it is feasible to impart a high degree of uniformity to a characteristic determined by the positional relationship between the lamps and their corresponding reflectors, for example, to illumination distribution, temperature distribution or the like;

(2) In each of the frame members, the first and second supporting holes are formed in such a manner that their levels are alternately and successively shifted, in other words, in the so-called staggered pattern. Thus, the levels of the sealed end portions of the lamps L in one group do not coincide the levels of the sealed end portions of the lamps L in another group which is adjacent to the former group, thereby permitting to arrange each of the lamps L close to the heating space S and to dispose the lamps L at a high density. As a result, it is possible to utilize light, radiated from the lamps L, with high efficiency.

(3) Each of the frame members serves as a column and each of reflectors serves as a panel forming a housing. Thus, it is unnecessary to provide any separate supporting frame. As a result, the number of parts has been reduced significantly and the furnace has been simplified in its entirety;

(4) Lamps and a reflector are held as unitary members by a pair of frame members and each frame member is used to support the lamps and reflectors in the adjacent two groups. Thus, a cylindrical light source surrounding the whole heating space S can be formed readily by combining a suitable plural number of frame members while changing the bent angles thereof. As a result, each object can be heated in its entirety;

(5) Since both ends of each lamp L extend out from its respective frame members, namely, from the heating space S, the hermetically-sealed end portions of the lamp L are not exposed to light radiated from other lamps. It is thus possible to avoid the service life reduction of a lamp due to burn-out of its thin metal foils or cracks which occur when its hermetically-sealed end portions 52, 52 are exposed to high temperatures;

(6) A cooling water pipe P is provided in contact with each of the frame members. Thus, it is possible to cool the frame members and, as a result, to avoid the overheating of the lamps L and reflectors; and (7) Since each lamp L is supported by causing it to extend through its corresponding supporting holes of frame members, installation and replacement of each lamp is easy.

Having now fully described the invention, it will be apparent to one of ordinary skill in the art that many changes and modifications can be made thereto without departing from the spirit or scope of the invention as set forth herein.

What is claimed is:

1. A light-radiant heating furnace comprising an assembly of:

at least a first, second and third frame members, each of which has two plate portions, arranged in such a manner that one of the plate portions of the first frame member opposes one of the plate portions of the second frame member disposed adjacent to the first frame member, and the other plate portion of the first frame member opposes one of the plate portions of the third frame member disposed adjacent to the first frame member at a side different from the second frame member;

a plurality of lamps making up a first plane light source unit and supported between the first frame member and the second frame member with sealed end portions thereof positioned at one side, extending out through first supporting holes formed through said one of the plate portions of the first frame member;

another plurality of lamps making up a second plane light source unit and supported between the first frame member and the third frame member with sealed end portions thereof positioned at one side, extending out through second supporting holes formed, at levels different from the first supporting holes by a distance at least equal to an outer diameter of the lamp, through said other plate portion of the first frame member;

a first reflector fixed to the first frame member in such a manner that the first reflector assumes a position predetermined relative to the first supporting holes and extends between the first frame member and the second frame member; and a second reflector fixed to the first frame member is such a manner that the second reflector assumes a position predetermined relative to the second supporting holes and extends between the first frame member and the third frame member.

2. A light-radiant heating furnace as claimed in claim 1, wherein first, second, third and fourth frame members, each of which has first and second plate portions extending perpendicularly to each other, are arranged in such a manner that the first and second plate portions of the first frame member oppose, respectively, the first plate portion of the second frame member and the second plate portion of the third frame member, and the first and second plate portions of the fourth frame member oppose, respectively, the first plate portion of the third frame member and the second plate portion of the second frame member, each of the first plate portions defines first supporting holes, each of the second plate portions defines second supporting holes at levels different from the first supporting holes by a distance at least equal to an outer diameter of one of said lamps, and said lamps are arranged respectively between the mutually-opposing first plate portions and between the mutually-opposing second plate portions with both sealed end portions of the lamps extending out through their corresponding first and second supporting holes, thereby forming four plane light source units combined in the shape of a prism having square bases.

3. A light-radiant heating furnace as claimed in claim 1, wherein each of the frame members is provided with a cooling water pipe.

* * * * *

UNITED STATES PATENT AND TRADEMARK OFFICE

CERTIFICATE OF CORRECTION

PATENT NO. : 4,511,788

DATED : April 16, 1985

INVENTOR(S) : Arai et al

It is certified that error appears in the above-identified patent and that said Letters Patent is hereby corrected as shown below:

Column 10, line 27, "is" should be --in--.

Signed and Sealed this

*Tenth* Day of *September 1985*

[SEAL]

*Attest:*

DONALD J. QUIGG

*Attesting Officer* *Acting Commissioner of Patents and Trademarks - Designate*